US006021645A

United States Patent [19]

Hara

[11] Patent Number: 6,021,645

[45] Date of Patent: Feb. 8, 2000

[54] FREEZING AND COOLING SYSTEM AND HEAT EXCHANGER DEVICE FOR CONDENSATION

[75] Inventor: Takao Hara, Kawaguchi, Japan

[73] Assignee: Green Cross Japna Foundation, Yono, Japan

[21] Appl. No.: 09/009,301

[22] Filed: Jan. 20, 1998

[30] Foreign Application Priority Data

Jan. 20, 1997 [JP] Japan ..... 9-019641
Nov. 14, 1997 [JP] Japan ..... 9-349898

[51] Int. Cl.[7] ..... F25B 41/00

[52] U.S. Cl. ..... 62/196.4; 62/113; 62/117; 62/513

[58] Field of Search ..... 62/513, 117, 113, 62/196.4

[56] References Cited

U.S. PATENT DOCUMENTS 2,183,343 12/1939 Alsing ..... 62/3
2,272,093 2/1942 McCormack ..... 62/115

*Primary Examiner*—Henry Bennett
*Assistant Examiner*—Marc Norman
*Attorney, Agent, or Firm*—Weneroth, Lind & Ponack, L.L.P.

[57] ABSTRACT

There is provided a freezing and cooling system as well as a condensing heat exchanger device capable of reducing in size of a condensing heat exchanger device, promoting a cost reduction of the device in a freezing and cooling system as well as energy saving and promoting to keep a global environment, wherein a freezing cycle is formed such that condensing gaseous refrigerant of high temperature and high pressure discharged from a compressor 1 is divided to flow, the over-half amount of condensing gaseous refrigerant is sent into an inner box 6 of a condenser 5 comprised of a double-box type heat exchanger of the inner box 6 and an outer box 7 enclosing the inner box 6, a residual amount of condensing gaseous refrigerant is sent to a capillary coil 8 acting as to increase flowing speed of refrigerant flowing in it, liquid refrigerant of low temperature and low pressure attained through condensing, reducing pressure and expanding at the capillary coil 8 is sent to the outer box 7 of the condenser 5 so as to perform a heat exchanging operation between it and condensing gaseous refrigerant in the inner box 6, thereby the condensing gaseous refrigerant in the inner box 6 is condensed and liquefied, and in turn the liquid refrigerant in the outer box 7 is evaporated and gasified, then liquid refrigerant of high pressure in the inner box 6 is sent to an expansion valve 3 through a liquid pipe 9 to reduce pressure and expand, then it is sent to a cooler 4 to perform a heat exchanging operation of evaporating latent heat between it and either air or cooling water, thereby the refrigerant is evaporated and gasified, the condensing gaseous refrigerant of low pressure evaporated and gasified at the cooler 4 is merged with condensing gaseous refrigerant of low pressure evaporated and gasified at the outer box 7, then the refrigerant is returned back to the compressor 1 and cold heat for use in freezing and cooling operation is obtained at the cooler 4.

8 Claims, 2 Drawing Sheets

FREEZING AND COOLING SYSTEM AND HEAT EXCHANGER DEVICE FOR CONDENSATION

BACKGROUND OF THE INVENTION

1. Field of the Invention

This invention relates to a new freezing and cooling system and a heat exchanger device for condensation used in this freezing and cooling system.

2. Description of the Related Art

As shown in FIG. 4, the freezing and cooling system generally used in the art is operated such that condensing gaseous refrigerant such as a fluorocarbon refrigerant enclosed during a freezing cycle is changed into gaseous refrigerant of high temperature and high pressure by a compressor 21, heat exchanged with air (or cooling water) by a condenser 22, condensed and liquefied to change its phase into liquid phase of which temperature is near its normal temperature, thereafter the liquid refrigerant is reduced in its pressure by an expansion valve 23 and expanded there to make liquid refrigerant of low temperature and low pressure, the liquid refrigerant is sent to a cooler (evaporator) 24 and heat exchanged with either air or cooling water so as to cause it to be evaporated and gasified, resulting in producing gaseous refrigerant of low temperature and low pressure and in turn, either air or cooling water is cooled to enable itself to be utilized as a source of cold heat for a freezing and cooling operation and the gaseous refrigerant of low temperature and low pressure is returned back to the compressor 21. In this case, it is well known in the art that, as the condenser 22, a cross-fin type heat exchanger is exclusively used for processing air and in turn, a shell-type heat exchanger is exclusively used for processing cooling water. In FIG. 4, reference numeral 25 denotes a fan for a cooler 24, and reference numeral 28 denotes an indoor device housing where each of the aforesaid indoor devices 21, 23, 24 and 25 is stored in it.

In such a prior art freezing and cooling system as described above, it may not be avoided that the condenser 22 acting as the heat exchanger at the heat source is large in size as compared with the cooler 24 acting as a heat exchanger at a utilizing side, resulting in that various kinds of studies have been applied to cause the condenser 22 to become small in size in order to make a compact-sized device. However, in the existing freezing and cooling system, it is technically difficult to make a substantial reduction of heat exchanging area required in condensing and liquefying of the refrigerant and so the large-sized condenser 22 is still applied for operation.

Referring now to an example of the prior art air conditioner for an automobile (a cooling air conditioner), the prior art will be described, wherein there were almost present some cases in which an air-cooled condenser having a large heat exchanging area was installed at a front surface space of a radiator, resulting in that an original capability of the radiator was remarkably reduced and surplus amount of fuel was also consumed to cause carbon dioxide to be forcedly discharged and further there was a problem that a heat exchanging amount of the condenser at the time of high temperature of surrounding atmosphere in summer season was lack and an air conditioner was frequently stopped in its operation.

Further, in the prior art cooling machine and cooler for industrial application, since an outdoor device installation space was wide in particular, so the piping and electrical wiring operations became large-scaled one and it was not possible to avoid some economic disadvantages that not only the expenditure for work was increased but also the work period was extended in a long period of time.

SUMMARY OF THE INVENTION

This invention has been constructed to eliminate the problems found in the prior art freezing and cooling system and it is an object of the present invention to provide a freezing and cooling system and a heat exchanger device for a condensation operation capable of attaining a small-sized heat exchanger for a condensation operation, reducing a cost of the device in the freezing and cooling system, promoting an energy saving and further causing the device to act as means for keeping a global environment.

In order to attain the aforesaid object, the present invention is constructed as follows. That is, the invention in claim 1 of the present invention relates to a freezing and cooling system characterized in that a freezing cycle is formed such that condensing gaseous refrigerant of high temperature and high pressure discharged from a compressor 1 is divided into an over-half amount and a residual amount, the over-half amount of condensing gaseous refrigerant is sent into an inner box 6 of a condenser 5 comprised of a double-box type heat exchanger of the inner box 6 and an outer box 7 enclosing the inner box 6, a residual amount of condensing gaseous refrigerant is sent to a capillary coil 8 acting as to increase speed and reduce pressure in respect to refrigerant flowing in it, liquid refrigerant of low temperature and low pressure attained through condensing, reducing pressure and expanding at the capillary coil 8 is sent to the outer box 7 of the condenser 5 so as to perform a heat exchanging operation between it and condensing gaseous refrigerant in the inner box 6, thereby the condensing gaseous refrigerant in the inner box 6 is condensed and liquefied, and in turn the liquid refrigerant in the outer box 7 is evaporated and gasified, then liquid refrigerant of high pressure in the inner box 6 is sent to an expansion valve 3 through a liquid pipe 9 provided with a helical heat transfer pipe 9A for use in generating eddy current to the liquid refrigerant so as to be reduced in pressure and expanded, thereafter the refrigerant is sent to a cooler 4 to perform a heat exchanging operation of evaporating latent heat between it and either air or cooling water, thereby the refrigerant is evaporated and gasified, the condensing gaseous refrigerant of low pressure evaporated and gasified at the cooler 4 is merged with condensing gaseous refrigerant of low pressure evaporated and gasified at the outer box 7, then the refrigerant is returned back to the compressor 1 and cold heat for use in freezing and cooling operation is obtained at the cooler 4.

In addition, the invention described in claim 2 of the present invention relates to a heat exchanger for a condensing operation characterized in that the same is comprised of a condenser 5 including a double box type heat exchanger with an inner box 6 and an outer box 7 enclosing the inner box 6; a capillary coil 8 including a helical fine heat transfer pipe increasing speed and reducing pressure against refrigerant flowing in the condenser and having a pipe outlet connected to a refrigerant inlet of the outer box 7; and a liquid pipe 9 provided with a helical heat transfer pipe 9A for producing eddy current in respect to the refrigerant flowing in it and having the pipe inlet connected to the refrigerant outlet of the inner box 6, wherein over-half amount of condensing gaseous refrigerant of high temperature and high pressure discharged out of the compressor 1 is fed into the inner box 6, a residual amount of condensing gaseous refrigerant of high temperature and high pressure discharged out of the compressor 1 with the over-half amount being subtracted is fed into the capillary coil 8, the gaseous refrigerant within the outer box 7 evaporated under a heat exchanging action is returned back to the suction side of the compressor 1, the liquid refrigerant in the inner box 6 condensed under a heat exchanging action sent to the expansion valve 3 through the liquid pipe 9, thereby a condensing stage in the freezing cycle is carried out by this device.

In accordance with the present invention, there is a feature in which a heat exchanging state in a condensing stage in the freezing and cooling system is quite different from that of the existing freezing and cooling system and basically the gist of the present invention consists in the fact that almost of a heat source for use in performing a condensing and a liquefying operation is attained by the circulating refrigerant itself by applying it to the condensing stage in the freezing cycle that a remarkable change in phase and temperature is produced in the stage for increasing speed and reducing pressure in respect to the condensing gaseous refrigerant.

That is, although the condensing stage in the existing freezing and cooling system is of a system in which the condensing gaseous refrigerant of high temperature and high pressure discharged out of the compressor is cooled with surrounding atmosphere or water to be condensed and liquefied, the new system of the present invention is characterized in that the same is comprised of a condensing system in which it does not need to apply a large amount of cooling fluid such as air or water or the like as a cooling heat source for use in condensing and liquifying operation, a part of the condensing gaseous refrigerant of high temperature and high pressure is divided to flow into the capillary coil 8 capable of reducing pressure while a flowing speed of the refrigerant flowing in it is being increased, thereby its heat is forcedly radiated to make a liquefied state and concurrently its pressure is reduced to change its phase into liquid refrigerant of low temperature having a cooling capability, the condensing gaseous refrigerant of high temperature and high pressure discharged out of the compressor is cooled and liquefied with this liquid refrigerant of low temperature.

Applying the aforesaid new system enables the present invention to attain a small-sized device of reduction of about 1/20 in its installing space as compared with that of the prior art condenser under the equivalent freezing and cooling capability and in other words, it is possible to pull out a condensing capability of about four times with the same size, thereby a device cost in the freezing and cooling system can be reduced and an energy saving in the freezing and cooling system can be attained.

The present invention is carried out in a form described above and has the following effects. That is, in accordance with the present invention, the condensing heat exchanging area can be reduced remarkably on the basis of a completion of the new freezing and cooling cycle in view of the fact that a large-sized condensing heat exchanging area is a major cause to produce a large-sized system, resulting in that a structure of the freezing and cooling system can be made compact in size, an excessive consumption of energy is reduced for its industrial application, a high efficiency operation of an engine of automobile is realized to enable a discharged amount of carbon dioxide into the surrounding atmosphere to be reduced and the present invention may provide a quite high contribution to the industry.

DESCRIPTION OF THE PREFERRED EMBODIMENTS

Figure 1:
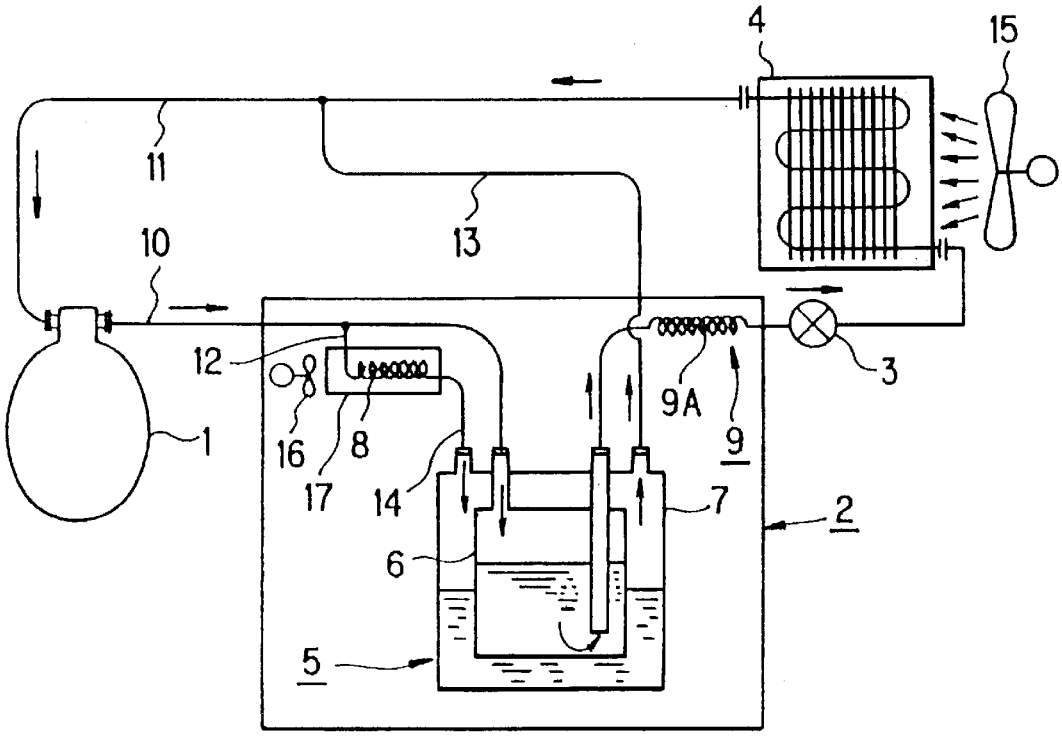
FIG. 1 is a freezing circuit diagram of a freezing and cooling system in a preferred embodiment of the present invention.

Referring now to the accompanying drawings, some preferred embodiments of the present invention will be described as follows. In FIG. 1 is illustrated a freezing circuit of a freezing and cooling system of the preferred embodiment of the present invention. The freezing and cooling system shown in FIG. 1 is comprised of, as composing devices, a compressor 1, a condensing heat exchanger device 2, an expansion valve 3 and a cooler 4, wherein these devices are connected in a circulating manner by a refrigerant pipe so as to constitute a freezing and cooling device.

Since the compressor 1, the expansion valve 3 and the cooler 4 have basically the same structure and function as those in the existing freezing and cooling device, their detailed description will be eliminated and a preferred embodiment of the heat exchanger 2 for condensing operation which is a composing element of the feature of the present invention will be described as follows.

The aforesaid heat exchanger 2 for a condensing operation has, as its composing members, a condenser 5, a capillary coil 8 and a liquid pipe 9, wherein the condenser 5 is comprised of an inner box 6 and an outer box 7 enclosing the inner box 6 at its entire circumference, and as a circumferential wall material of the inner box 6, a plate member of material quality having a superior heat transferring performance such as a copper plate or the like, thereby a double-box type heat exchanger capable of performing an efficient heat exchanging operation between both boxes 6 and 7 is formed. The inner box 6 and the outer box 7 have each of a refrigerant inlet and a refrigerant outlet at an outer wall section, respectively. To the refrigerant inlet of the inner box 6 is connected a flowing-out end of a high pressure gas pipe 10 and to the refrigerant outlet of the inner box 6 is connected a flowing-in end of the liquid pipe 9. In turn, to the refrigerant inlet of the outer box 7 is connected a flowing-out end of the liquid pipe 14 and to the refrigerant outlet of the outer box 7 is connected a flowing-in end of the gas pipe 13.

The capillary coil 8 is comprised of a coil tube in which a fine diameter heat transfer pipe having a superior heat transfer performance of predetermined length of several meters, for example, a copper tube with a diameter of 3.12 mm (1/8 in), for example, is wound in a helical form, and in the example of the preferred embodiment, it is stored in a fine elongated casing 17, surrounding atmosphere is blown into the casing 17 by an accompanying fan 16 so as to promote cooling operation. This capillary coil 8 has a feature that a pressure of the refrigerant can be reduced in concurrent with an increasing in speed of flowing speed of the refrigerant flowing in it, wherein a flowing-out end of a branched gas pipe 12 branched and connected to the high pressure gas pipe 10 is connected to its flowing-in end and in turn, a flowing-in end of the liquid pipe 14 is connected to the flowing-out end.

The liquid pipe 9 is a pipe passage for use in flowing the liquid refrigerant condensed and liquefied at the inner box 6 to the expansion valve 3, the helical heat transfer pipe 9A is installed at a part of or all of the pipe passage, and its flowing-out end is connected to an inlet of the expansion valve 3. In addition, a reason why the liquid pipe 9 is provided with the helical heat transfer pipe 9A consists in the fact that an eddy current is produced positively at the liquid refrigerant flowing in the heat transfer pipe to attain a certain distance and at the same time a flowing speed of it is increased to promote a pressure reduction, thereby a pressure at the inlet port of the expansion valve 3 is effectively decreased to perform a smooth reduction in pressure and expansion for attaining the liquid refrigerant of low pressure and low temperature.

The freezing and cooling system provided with a condensing heat exchanger device 2 constructed as described above is made such that a low pressure side outlet port of the expansion valve 3 is connected to a refrigerant inlet of the cooler 4 through the liquid pipe, the refrigerant inlet of this cooler 4 is connected to a sucking port of the compressor 1 through a sucking low pressure gas pipe 11, a flowing-in side of the high pressure gas pipe 10 is connected to a discharging port of the compressor 1 and at the same time the flowing-out end of the gas pipe 13 is branched and connected to a midway part of the low pressure gas pipe 11 to form a closed circulating circuit of condensing gaseous refrigerant.

An operating state of this freezing and cooling system will be described in reference to a case of the device in which fluorocarbon refrigerant R12, for example, is applied as condensing gaseous refrigerant, wherein a condensing gaseous refrigerant (a) of high temperature and high pressure discharged out of the discharging port of the compressor 1 is branched in its over-half amount to flow to a high pressure gas pipe 10 and is branched, in its residual amount, to the branched gas pipe 12, and the condensing gaseous refrigerant of over-half amount of 60%, for example, is flowed into the inner box 6 of the condenser 5. In turn, the condensing gaseous refrigerant of residual amount of 40%, for example, is flowed in the capillary coil 8, condensed and liquefied there, thereafter its pressure is reduced to become liquid refrigerant (b) of low temperature and then the refrigerant is flowed into the outer box 7 of the condenser 5.

The gaseous refrigerant of high temperature and high pressure within the inner box 6 and the liquid refrigerant of low temperature and low pressure in the outer box 7 are heat exchanged to each other, the gaseous refrigerant of high temperature and high pressure in the inner box 6 radiates condensing latent heat, the refrigerant is liquefied to become liquid refrigerant (c) of high pressure, the liquid refrigerant of low temperature and low pressure in the outer box 7 retrieves an evaporating latent heat, gasified to become gaseous refrigerant of low pressure (d). The liquid refrigerant of high pressure accumulated in the inner box 6 is reduced in its pressure while passing through the liquid pipe 9 to become liquid refrigerant of middle pressure (e). This liquid refrigerant of middle pressure (e) reaches the expansion valve 3, is expanded in its reduced pressure to become liquid refrigerant (f) of low pressure and low temperature, thereafter the refrigerant is fed into the cooler 4, heat exchanged with evaporating latent heat between it and air generated by the fan 15 so as to be evaporated and gasified. The gaseous refrigerant (g) of low pressure evaporated and gasified at the cooler 4 is merged with gaseous refrigerant (d) of low pressure evaporated and gasified at the outer box 7, thereafter the merged refrigerant is sucked into the compressor 1 and the aforesaid freezing cycle is formed. The air blown by the fan 15 is cooled with the cooler 4 in this freezing cycle and then a cold heat source for freezing and cooling operation can be attained.

Although as regards each of conditions such as material quality of metal to be used, a length and a diameter of pipe, a diameter, pitch and winding direction of a helical part of the capillary coil 8 which may act as an important composing element of the present invention, it is satisfactory to prepare a fine diameter heat transfer pipe having appropriate conditions may be selected after repeating various kinds of tests, in this case, it is possible to set the most-appropriate ones in response to each of the conditions of application such as the type of refrigerant, pressure and temperature of gaseous refrigerant at the inlet port and pressure, temperature of liquid refrigerant at the outlet port and further it is of course possible to use, as the capillary tube, one fine diameter heat transfer pipe having a predetermined size machined into a helical tube or member having two series-connected helical fine diameter heat transfer pipes having different winding direction, and if the capillary coil having a condition capable of performing an efficient increasing in speed and decreasing in pressure is optionally selected. In addition, they may be connected in series with the expansion valve being used in the capillary coil 8.

Embodiment 1

Figure 2:
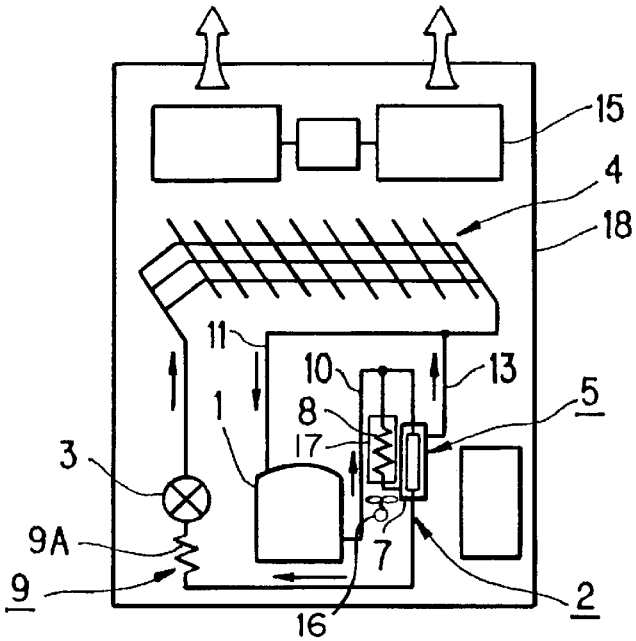
FIG. 2 is a system configuration view for an industrial cooling device in a first preferred embodiment of the present invention.
Figure 4:
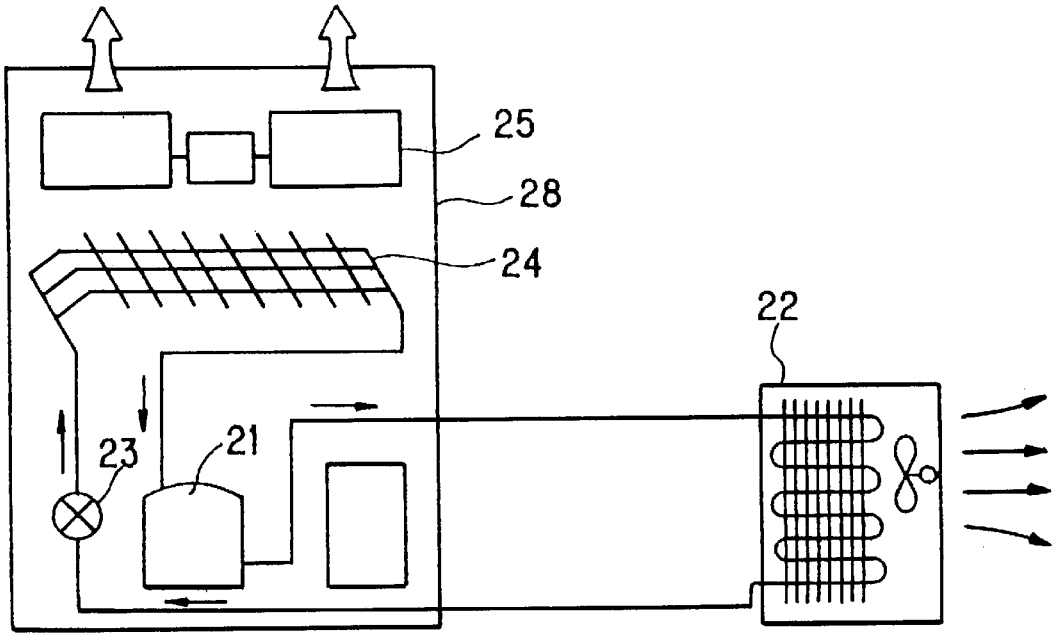
FIG. 4 is a system configuration view for the prior art freezing and cooling system.

In FIG. 2 is illustrated a system configuration figure of an industrial cooling device in accordance with the first preferred embodiment of the present invention. The cooling device shown in this figure normally belongs to the type called as an air-cooled package type, wherein a compressor 1, a condensing heat exchanger 2, an expansion valve 3, a cooler 4 and a fan 15 for the cooler composed of a roll type fan are totally stored in a housing 18 placed within an indoor area. In this case, the condensing heat exchanger 2 comprised of a condenser 5, a capillary coil 8 and a liquid pipe 9 is quite small in size as compared with that of the air-cooled type condenser 22 (refer to FIG. 4) of the prior art system and the surrounding atmosphere is not used as a main cooling heat source, so that it is possible to install it in a narrow space in the housing 18 having a superior aeration characteristic and accordingly, the gas pipe and the liquid pipe communicating between it and the condenser 22 installed at an outdoor area can be eliminated and the cost of device as well as expenditure of installing work or the like can be reduced.

In addition, the prior art air-cooled type condenser 22 provided a condensing and liquefying process through a forced air blowing of the surrounding atmosphere with a temperature of about 25 to 60° C., resulting in that a large-sized cooling heat exchanging area was required. To the contrary, the condenser 5 of the condensing heat exchanger 2 of the present invention utilizes refrigerant liquefied at a low temperature less than an icing point of −20° C. or the like, so that a similar cooling capability can be attained with a heat exchanging area of less than 1/20 in regard to the prior art condenser for air.

In the aforesaid first preferred embodiment, states of pressure and temperature of the refrigerant at each of the sections in the practical embodied device with fluorocarbon R22 being applied as condensing gaseous refrigerant become as follows in reference to FIG. 2: a condensing gaseous refrigerant of high temperature and high pressure (a): 15 kg/cm$^2$, 85° C., liquid refrigerant of low temperature and middle pressure (g): 7 kg/cm$^2$, 12° C., liquid refrigerant of low temperature and low pressure (b): −50 mm (a mercury column), −20° C., liquid refrigerant of high pressure (c): 14 kg/cm$^2$, 35° C., gaseous refrigerant of low pressure (d): −50 mm (a mercury column), −20° C., liquid refrigerant of middle pressure (e): 0 kg/cm$^2$, −5° C., liquid refrigerant of low pressure and low temperature (f): −50 mm (a mercury column), −20° C., gaseous refrigerant of low pressure (g): −50 mm (a mercury column), −20° C.

Embodiment 2

Figure 3:
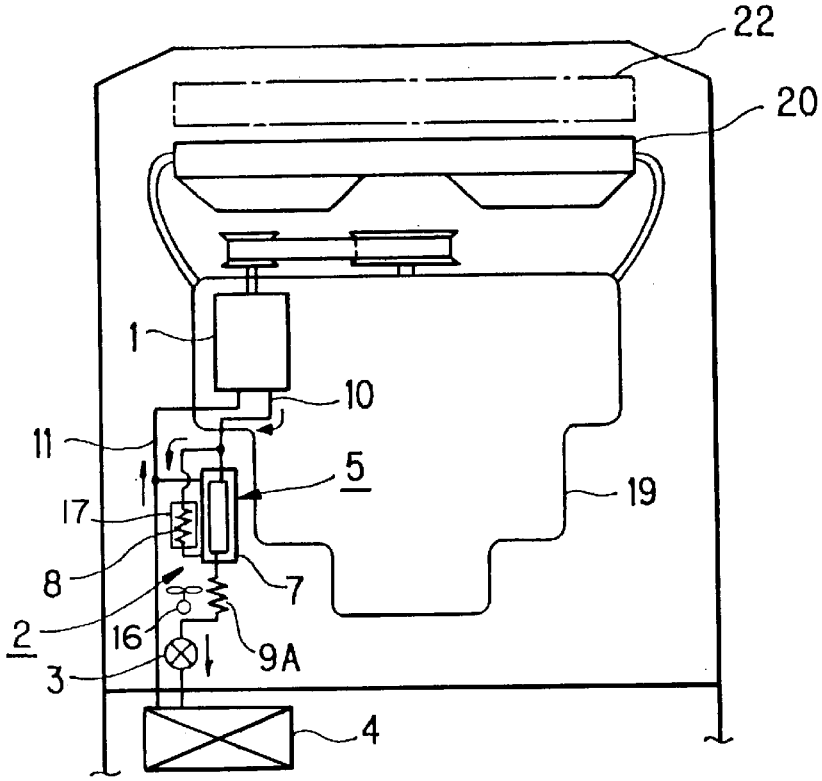
FIG. 3 is a system configuration view for an air conditioner for an automobile in a second preferred embodiment of the present invention.

In FIG. 3 is illustrated a system configuration figure for an air conditioner for automobile of the second preferred embodiment of the present invention. The cooling device shown in this figure is constructed such that a compressor 1, a condensing heat exchanger 2 and an expansion valve 3 are stored in compact in an engine room having an engine 19 and a radiator 20 installed therein and then a cooler 4 is fixed in compartment, wherein the condensing heat exchanger 2 is quite small in size and the surrounding atmosphere is not applied as a positive cooling heat source, so that it is possible to mount it within a narrow space having a superior aeration characteristic within the engine room as shown in the figure and as compared with the system in which the prior art air conditioner for automobile is installed at a front up-stream side of the radiator 20 as indicated by a dotted line in FIG. 3, the original capability can be sufficiently drawn out in regard to the radiator 20 and a performance of the engine of the automobile can be improved.

In the aforesaid second preferred embodiment, as regards the practical embodied device using the fluorocarbon refrigerant R12 applied as condensing gaseous refrigerant, states of pressure and temperature of it become as follows in reference to FIG. 3: a condensing gaseous refrigerant of high temperature and high pressure (a): 15 kg/cm$^2$, 80° C., liquid refrigerant of low temperature and low pressure (b): −250 mm (a mercury column), −20° C., liquid refrigerant of high pressure (c): 15 kg/cm$^2$, 60° C., gaseous refrigerant of low pressure (d): −250 mm (a mercury column), 2° C. liquid refrigerant of middle pressure (e): 2 kg/cm$^2$, −5° C., liquid refrigerant of low pressure and low temperature (f): −250 mm (a mercury column), −20° C., gaseous refrigerant of low pressure (g): −250 mm (a mercury column), 2° C.

What is claimed is:

1. A freezing system which uses a refrigerant, comprising:

a compressor including an inlet and an outlet;

a capillary coil for increasing speed and reducing pressure of the refrigerant flowing in said capillary coil, said capillary coil connected to said outlet of said compressor, said capillary coil including an outlet;

a single condenser directly connected to said outlet of said compressor, said condenser comprising a double-box heat exchanger including an inner box and an outer box, said outer box including an inlet connected to said outlet of said capillary coil and an outlet connected to said inlet of said compressor, said inner box including an inlet directly connected to said outlet of said compressor and an outlet, wherein over half of the refrigerant can flow into said inner box and a remaining amount of the refrigerant can flow into said outer box from said capillary coil;

a liquid pipe connected to said outlet of said inner box, said liquid pipe including a helical pipe for producing an eddy current in the refrigerant flowing in said helical pipe;

an expansion valve connected to said helical pipe; and a cooler including an inlet connected to said expansion valve and an outlet connected to said inlet of said compressor.

2. The freezing system of claim 1, wherein said cooler includes a fan.

3. The freezing system of claim 2, further comprising:

a casing provided around said capillary coil.

4. The freezing system of claim 3, further comprising:

a capillary-coil-fan for cooling said capillary coil.

5. The freezing system of claim 4, further comprising:

a housing for enclosing said components.

6. A heat exchanger device for cooling a refrigerant from a compressor, the compressor including an inlet and an outlet, the heat exchanger device comprising:

a capillary coil for increasing speed and reducing pressure of the refrigerant flowing in said capillary coil, said capillary coil directly connected to the outlet of the compressor, said capillary coil including an outlet;

a single condenser directly connected to the compressor, said condenser comprising a double-box heat exchanger including an inner box and an outer box, said outer box including an inlet connected to said outlet of said capillary coil and an outlet connected to the inlet of the compressor, said inner box including an inlet directly connected to the outlet of the compressor and an outlet, wherein over half of the refrigerant can flow into said inner box and a remaining amount of the refrigerant can flow into said outer box from said capillary coil; and a liquid pipe connected to said outlet of said inner box, said liquid pipe including a helical pipe for producing an eddy current in the refrigerant flowing in said helical pipe.

7. The heat exchanger device of claim 6, further comprising:

a casing provided around said capillary coil.

8. The heat exchanger device of claim 6, further comprising:

a fan for cooling said capillary coil.

* * * * *